US011911708B2

(12) United States Patent
Wood et al.

(10) Patent No.: US 11,911,708 B2
(45) Date of Patent: Feb. 27, 2024

(54) BODY MOUNTING SYSTEM FOR A MODEL VEHICLE

(71) Applicant: TRAXXAS, L.P., McKinney, TX (US)

(72) Inventors: Jonathan Scott Wood, Campbell, CA (US); Casey Christen Jens Christensen, McKinney, TX (US); Skylar Hagler, Anna, TX (US); Otto Karl Allmendinger, Rowlett, TX (US); Kent Poteet, Lucas, TX (US)

(73) Assignee: TRAXXAS, L.P., McKinney, TX (US)

( * ) Notice: Subject to any disclaimer, the term of this patent is extended or adjusted under 35 U.S.C. 154(b) by 126 days.

(21) Appl. No.: 17/552,987

(22) Filed: Dec. 16, 2021

(65) Prior Publication Data

US 2022/0193566 A1 Jun. 23, 2022

Related U.S. Application Data

(60) Provisional application No. 63/127,662, filed on Dec. 18, 2020.

(51) Int. Cl.
*A63H 17/26* (2006.01)
*A63H 30/04* (2006.01)

(52) U.S. Cl.
CPC ..... *A63H 17/262* (2013.01); *A63H 17/264* (2013.01); *A63H 30/04* (2013.01)

(58) Field of Classification Search
CPC ..... A63H 17/00; A63H 17/002; A63H 17/26; A63H 17/262; A63H 17/264
(Continued)

(56) References Cited

U.S. PATENT DOCUMENTS 1,895,968 A * 1/1933 Brubaker ..... A63H 17/262 446/471
2,141,267 A * 12/1938 Dillon ..... B62D 33/04 296/35.1

(Continued)

FOREIGN PATENT DOCUMENTS

CN 202242977 U 5/2012
CN 202822774 U 3/2013

(Continued)

OTHER PUBLICATIONS

European Search Report; European Patent Application No. EP 21183318; completed Nov. 12, 2021.

*Primary Examiner* — Alexander R Niconovich
(74) *Attorney, Agent, or Firm* — Daryl R. Wright; Greg Carr

(57) ABSTRACT

A body mounting assembly, model vehicle, and method for engaging a model vehicle body to a model vehicle chassis are provided. The body mounting assembly includes a latch assembly. The latch assembly further includes a latch member with a latch engagement surface. The body mounting assembly also includes a retainer assembly. The retainer assembly further includes a retainer engagement surface. The latch assembly is releasably engaged to the retainer assembly when the latch engagement surface and the retainer engagement surface are interlock together. The latch engagement surface and the retainer engagement surface comprise negative engagement angles. A body mount able to be coupled to a model vehicle body includes one of the latch assembly or the retainer assembly and a chassis mount able to be coupled to the model vehicle chassis includes the other corresponding retainer assembly or the latch assembly corresponding to the body mount.

17 Claims, 9 Drawing Sheets

(58) Field of Classification Search
USPC ..... 446/465, 470, 471
See application file for complete search history.

(56) References Cited

U.S. PATENT DOCUMENTS 2,691,244 A * 10/1954 Steinke ..... A63H 17/06 298/22 J
3,350,813 A * 11/1967 Isaacson ..... A63H 29/22 446/462
3,594,949 A * 7/1971 Tam ..... A63H 17/26 446/438
3,629,968 A * 12/1971 Linstead ..... A63H 17/002 446/95
3,653,149 A * 4/1972 Prodger ..... A63H 17/26 446/471
3,721,042 A * 3/1973 Marason, Jr. ..... A63H 17/26 446/471
3,924,349 A * 12/1975 Wamsley ..... A63H 17/002 446/95
3,942,285 A * 3/1976 Dehner ..... A63H 17/05 446/470
3,959,920 A * 6/1976 Ieda ..... A63H 17/262 446/6
3,962,820 A * 6/1976 Good ..... A63H 17/26 446/471
4,021,961 A * 5/1977 Good ..... A63H 17/262 446/469
4,466,215 A * 8/1984 Hanazato ..... A63H 33/003 446/469
4,470,219 A * 9/1984 Sugimoto ..... A63H 17/262 446/471
4,573,941 A * 3/1986 Holden ..... A63H 17/38 446/454
4,615,686 A * 10/1986 Bartos ..... A63H 17/262 446/469
4,655,727 A * 4/1987 Swisher ..... A63H 33/003 446/470
4,678,451 A * 7/1987 Ventura ..... A63H 17/262 446/471
4,695,267 A * 9/1987 Simmel ..... A63H 17/262 446/471
4,764,150 A * 8/1988 Uchino ..... A63H 17/26 446/460
4,911,669 A * 3/1990 Parker ..... A63H 17/02 446/6
4,940,442 A * 7/1990 Matsuda ..... A63H 17/264 446/457
4,986,789 A * 1/1991 Hang ..... G09B 19/00 446/470
4,993,983 A * 2/1991 Kurita ..... A63H 17/26 446/272
5,002,515 A * 3/1991 Aoyagi ..... A63H 17/26 446/457
5,167,563 A * 12/1992 Saffer ..... A63H 17/262 446/466
5,292,275 A * 3/1994 Swisher ..... A63H 17/268 446/470
5,322,469 A * 6/1994 Tilbor ..... A63H 17/004 446/454
5,334,078 A * 8/1994 Hippely ..... A63H 17/26 446/470
5,380,231 A * 1/1995 Brovelli ..... A63H 17/40 446/6
5,482,494 A * 1/1996 Ishimoto ..... A63H 17/004 446/466
5,816,888 A * 10/1998 Myers ..... A63H 17/004 446/471
5,919,077 A * 7/1999 Gondcaille ..... A63H 17/262 446/469
7,100,968 B2 * 9/2006 Mataja ..... B62K 9/00 446/470
7,387,558 B2 * 6/2008 Swisher ..... A63H 17/02 446/470
7,568,962 B2 * 8/2009 Amadio ..... A63H 17/002 446/470
7,641,263 B2 * 1/2010 Ruslanov ..... A63H 17/002 446/470
7,717,767 B2 * 5/2010 Amadio ..... A63H 17/262 446/427
8,579,674 B2 * 11/2013 Carlson ..... A63H 29/20 446/469
9,370,725 B2 * 6/2016 Choi ..... A63F 1/04
10,709,994 B2 * 7/2020 Kwan ..... A63H 17/262
10,894,218 B2 * 1/2021 Allmendinger ..... A63H 29/00
11,833,439 B2 * 12/2023 Wei ..... A63H 17/264
2002/0094751 A1 * 7/2002 Clark, Jr. ..... A63H 18/08 446/431
2003/0073377 A1 * 4/2003 Mataja ..... B62K 9/00 446/469
2003/0236121 A1 * 12/2003 Byers ..... A63H 17/26 463/62
2005/0070390 A1 * 3/2005 Irikura ..... F16H 61/444 475/23
2005/0079792 A1 * 4/2005 Ogihara ..... A63H 17/262 446/456
2008/0143141 A1 6/2008 Ruslanov et al.
2009/0036021 A1 * 2/2009 Byers ..... A63H 17/26 446/469
2011/0176861 A1 * 7/2011 Nakayama ..... A63H 17/262 403/122
2013/0309938 A1 * 11/2013 Houlahan ..... A63H 17/262 446/466
2015/0050859 A1 2/2015 Choi
2015/0367242 A1 * 12/2015 Calello ..... A63H 17/002 446/465
2022/0001290 A1 * 1/2022 Ewing ..... A63H 17/262
2022/0016538 A1 * 1/2022 Wei ..... A63H 29/22
2022/0126214 A1 * 4/2022 Kwan ..... A63H 17/262
2022/0193566 A1 6/2022 Wood et al.
2022/0341457 A1 * 10/2022 Gokavi ..... F16B 21/086
2023/0219010 A1 * 7/2023 Christensen ..... A63H 17/264 446/471
2023/0256355 A1 * 8/2023 Conway ..... A63H 33/003 446/56

FOREIGN PATENT DOCUMENTS

EP 2818217 A2 12/2014
TW 201138918 A 11/2011

* cited by examiner

BODY MOUNTING SYSTEM FOR A MODEL VEHICLE

RELATED APPLICATIONS

This application claims the benefit of a related U.S. Provisional Application Ser. No. 63/127,662 filed Dec. 18, 2020, entitled "BODY MOUNT SYSTEM FOR A MODEL VEHICLE," to Jonathan Scott WOOD, et al., the disclosure of which is incorporated by reference herein in its entirety.

BACKGROUND

The following descriptions and examples are not admitted to be prior art by virtue of their inclusion in this section.

Radio-Controlled or RC model vehicles are a popular hobby for a growing segment of the population. As the hobby has grown and expanded, the electronics have become more sophisticated and propulsion systems have expanded to include both electronically powered along with nitro or combustible fuel powered RC vehicles. Various factors such as the ease of operation, the run time of RC model vehicles, and the features and abilities of the RC model vehicles have increased dramatically to provide a more realistic operational environment. However, one area that may not have seen similar levels of development with regards to the ease of operation is the removal and attachment of a model vehicle body to a model vehicle chassis.

Traditional methods of removal and attachment of a model vehicle body have involved aligning a series of holes in a model vehicle body with a corresponding series of mounting posts attached to a model vehicle chassis. The mounting posts are extended through the holes from the interior of the model vehicle body. Small metal clips are then inserted through holes in the visible portions of the mounting post to secure the model vehicle body to the model vehicle chassis. This process takes time. In addition, a user has to be on guard against losing or misplacing any of the clips, oftentimes in an outdoor environment. Since the model vehicle body must be removed every time in order to activate the RC model vehicle or whenever there is a need to change or charge the batteries (such as with electrical propulsion systems), valuable run time is wasted performing this required and complex procedure.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In accordance with one embodiment, a body mounting assembly is provided including a latch assembly comprising a latch member. The latch member includes a latch engagement surface. The body mounting assembly includes a retainer assembly comprising a retainer engagement surface. The latch assembly is releasably coupled to the retainer assembly when the latch engagement surface and the retainer engagement surface interlock together. The latch engagement surface and the retainer engagement surface comprise negative engagement angles. Wherein a body mount configured to be coupled to a model vehicle body comprises one of the latch assembly or the retainer assembly and a chassis mount configured to be coupled to the model vehicle chassis comprises a corresponding one of the retainer assembly or the latch assembly corresponding to the body mount.

In another embodiment a model vehicle is provided that includes a body mounting assembly. The body mounting assembly includes a reinforcement member and a latch assembly. The latch assembly includes a latch member comprising a latch engagement surface. The body mounting assembly further includes a reinforcement retainer and a retainer assembly. The retainer assembly includes a retainer aperture comprising a retainer engagement surface.

The first side of the retainer aperture comprises the retainer engagement surface. The latch assembly is releasably coupled to the retainer assembly when the latch engagement surface and the retainer engagement surface interlock together. Further, the reinforcement member is constrained in at least one direction by the reinforcement retainer after assembly. And the latch engagement surface and the retainer engagement surface comprise negative engagement angles.

In addition, the body mounting assembly includes a body mount coupled to a model vehicle body that includes one of the latch assembly or the retainer assembly, and one of the reinforcement member or the reinforcement retainer. The body mounting assembly also includes a chassis mount coupled to a model vehicle chassis that includes a corresponding other of the retainer assembly or the latch assembly, and a corresponding other of the reinforcement retainer or the reinforcement member corresponding to the body mount.

In still another embodiment a method for securing a model vehicle body to a model vehicle chassis is provided. The method includes providing a latch assembly including a latch member comprising a latch engagement surface. The method also includes providing a retainer assembly that includes a retainer aperture. The retainer aperture includes a retainer engagement surface.

Still further, the method includes engaging the latch assembly and the retainer assembly, interlocking the latch engagement surface and the retainer engagement surface. Wherein a body mount coupled to a model vehicle body comprises one of the latch assembly or the retainer assembly and wherein a chassis mount coupled to a model vehicle chassis comprises a corresponding other of the retainer assembly or the latch assembly corresponding to the body mount. Wherein the latch engagement surface and the retainer engagement surface comprise negative engagement angles.

Other or alternative features will become apparent from the following description, from the drawings, and from the claims.

BRIEF DESCRIPTION OF THE DRAWINGS

Certain embodiments will hereafter be described with reference to the accompanying drawings, wherein like reference numerals denote like elements. It should be understood, however, that the accompanying drawings illustrate only the various implementations described herein and are not meant to limit the scope of various technologies described herein. The drawings are as follows.

DETAILED DESCRIPTION

Figure 1:
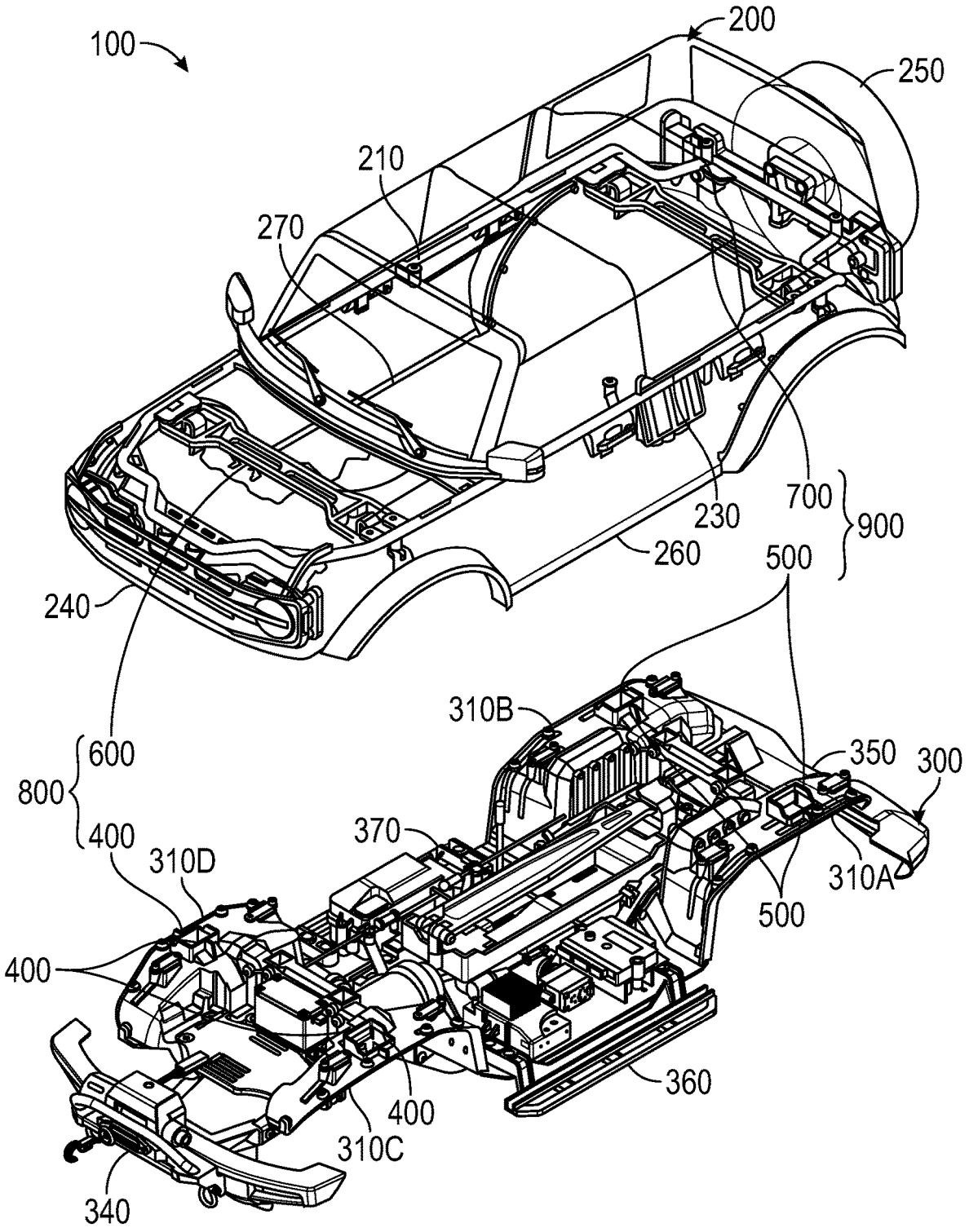
FIG. 1 is a schematic assembly view of a model vehicle body and a model vehicle chassis incorporating a body mounting assembly, according to an embodiment of the current disclosure.

In the following specification, numerous specific details are set forth to provide a thorough understanding of embodiments of the present disclosure. However, those skilled in the art will appreciate that the embodiments may be practiced without such specific details. In other instances, well-known elements have been illustrated in schematic or block diagram form in order not to obscure embodiments of the present disclosure in unnecessary detail.

Reference throughout the specification to "one embodiment," "an embodiment," "some embodiments," "one aspect," "an aspect," or "some aspects" means that a particular feature, structure, method, or characteristic described in connection with the embodiment or aspect is included in at least one embodiment of the present disclosure. Thus, the appearance of the phrases "in one embodiment" or "in an embodiment" or "in some embodiments" in various places throughout the specification are not necessarily all referring to the same embodiment. Furthermore, the particular features, structures, methods, or characteristics may be combined in any suitable manner in one or more embodiments. The words "including," "comprising," "containing" and "having" shall have the same meaning as the word "comprising."

Moreover, inventive aspects lie in less than all features of a single disclosed embodiment. Thus, the claims following the Detailed Description are hereby expressly incorporated into this Detailed Description, with each claim standing on its own as a separate embodiment.

Radio Controlled (RC) model vehicles usually comprise a scale version of a model vehicle body coupled to a model vehicle chassis. The model vehicle chassis contains the electronics and servos required for operating an RC model vehicle. The propulsion systems could be a combustion engine (e.g., nitro powered engine) or electric motor (e.g., dc battery powered motor). In most cases, the model vehicle body must be removed in order to activate and deactivate the Electronic Speed Control (ESC), or in the case of electric propulsion, to charge, replace, or connect a battery pack. Conversely, during operation, the model vehicle body must remain securely coupled to the model vehicle chassis while the vehicle is run under a variety of conditions and circumstances.

Previous versions of RC model vehicles would typically include mounting posts, coupled to a model vehicle chassis, with protruding features located at the top of each of the posts extending through the model vehicle body. Each of the protruding features may include holes to attach individual clips, for example. The model vehicle body is lowered onto the model vehicle chassis, allowing the protruding features to extend above an exterior surface of the model vehicle body. The model vehicle body rests upon body support pads coupled to the mounting posts. Then a number of small clips are inserted through the holes in the protruding features to secure the model vehicle in place between the clips and the body support pads.

When the model vehicle body is removed from the model vehicle chassis, sometimes at a track or in the field, a few of the many clips may be lost or misplaced. This results in frustration and an inability to fully secure the model vehicle body afterwards, unless a supply of spare clips is maintained. In addition, inserting and removing each of the clips into the holes at the top of the mounting posts requires precision and time. The precision is primarily needed for inserting clips into the holes, but time is required for both the insertion and removal of clips from each of the mounting posts. Accordingly, the entire process for removing and replacing the model vehicle body takes a relatively long time to perform and comes with the risk of losing one or more of the many clips needed to fully secure the model vehicle body.

Referring generally to FIG. 1, this figure shows an embodiment of a model vehicle 100 including a transparent model vehicle body 200 and a model vehicle chassis 300. In this illustrative embodiment, the model vehicle 200 is coupled to a first body mounting assembly 800, comprising a first body mount 600 and a corresponding first chassis mount 400. In addition, the model vehicle body 200 is coupled to a second body mounting assembly 900, comprising a second body mount 700 and a corresponding second chassis mount 500.

In this particular embodiment, two body mounting assemblies 800,900 are shown mounted transversely in the model vehicle body 200 and the model vehicle chassis 300. They could equivalently be mounted longitudinally in the model vehicle body 200 and the model vehicle chassis 300. While two body mounting assemblies 800,900 are shown in this illustrative example, there could be one or three or more in other embodiments according to application.

The first body mounting assembly 800 is shown near the model vehicle's 100 body front 240 and chassis front 340. The second body mounting assembly 900 is shown near the model vehicle's 100 body rear 250 and chassis rear 350. However, in other embodiments the first and second body mounting assemblies 800, 900 could alternatively be in the middle or along the model vehicle's 100 body left side 260 and chassis left side 360 and/or the model vehicle's 100 body right side 270 and chassis right side 370. Appropriate placement and numbers of body mounting assemblies 800, 900 may vary according to model vehicle type and/or configuration.

Figure 2:
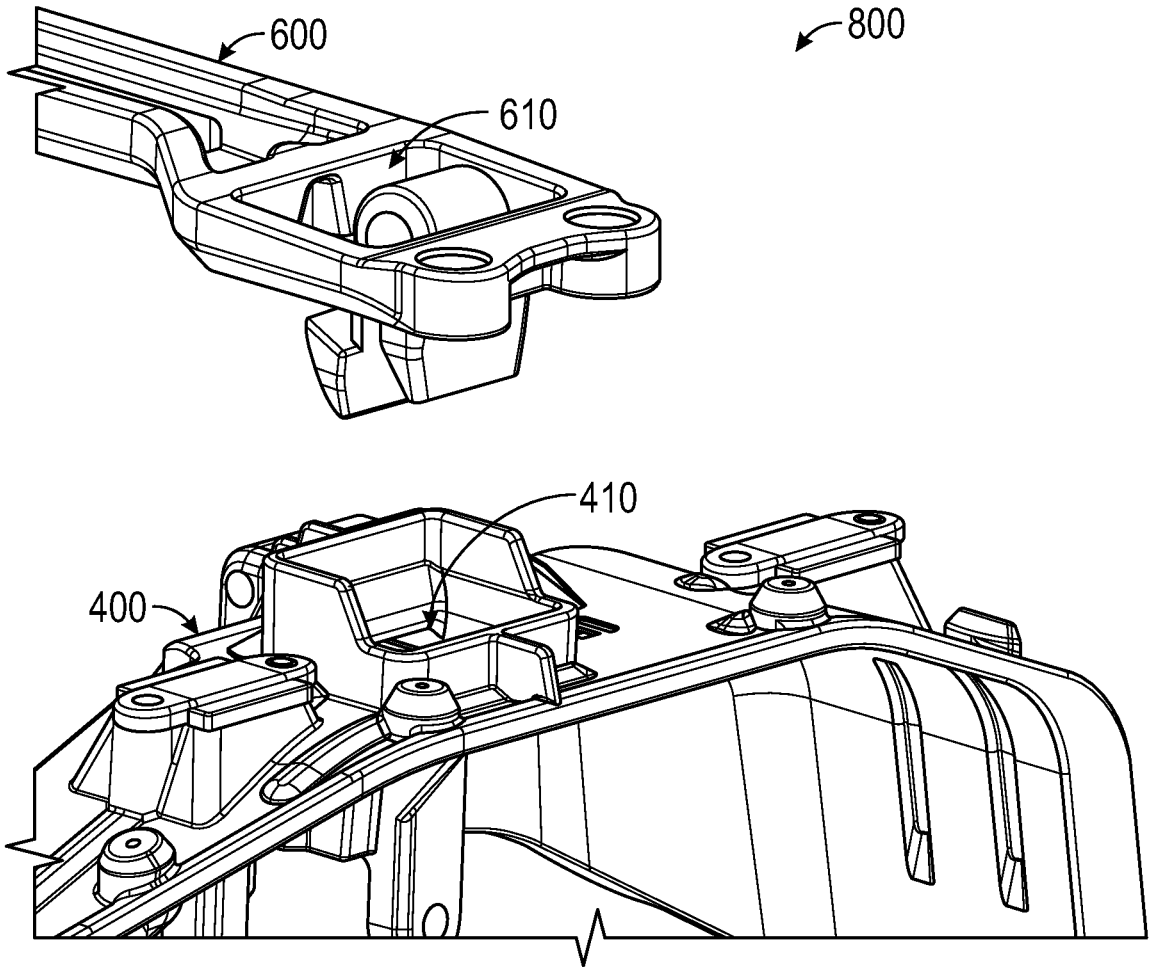
FIG. 2 is an enlarged partial assembly view of a latch assembly and a retainer assembly prior to assembly of a body mounting assembly, according to an embodiment of the current disclosure.

Looking at FIG. 2, this generally representative example shows an enlarged schematic portion of an assembly view of the first body mounting assembly 800's first body mount 600 and first chassis mount 400 in an unassembled condition. The first body mounting assembly 800 will be described in detail as an exemplary embodiment of a body mounting assembly. Only the first body mounting assembly 800 will be discussed in the interest of reducing redundancy. And although 'first' nomenclature will be used to signify the first body mounting assembly 800 components, the detailed description should be read as though the specific 'first' was not present and that the description applied to a general description of an embodiment of the component following that prefix.

Figure 3:
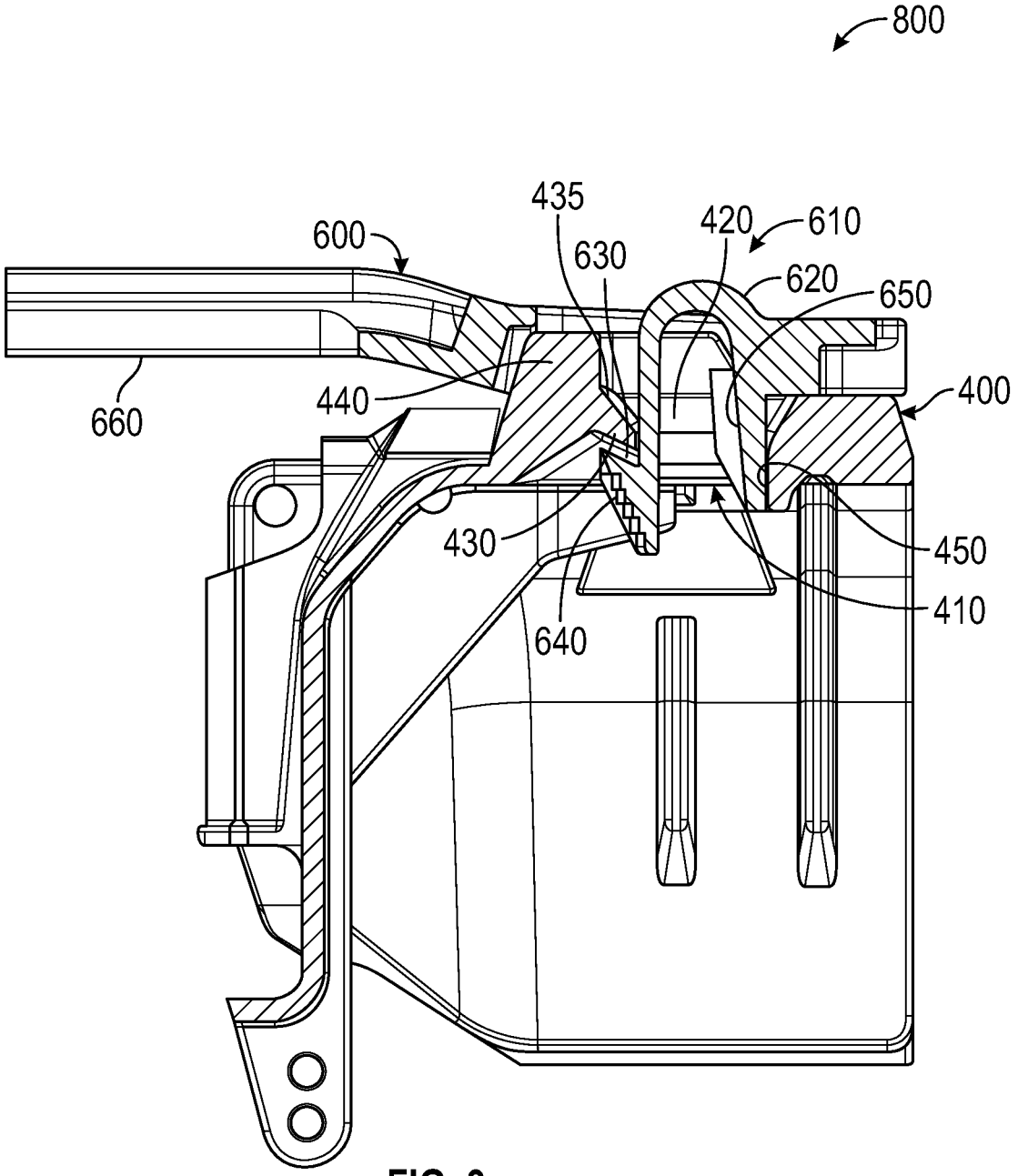
FIG. 3 is an enlarged sectional view of the latch assembly and the retainer assembly of FIG. 2 after assembly of a body mounting assembly, according to an embodiment of the current disclosure.

Turning to FIG. 3, this exemplary illustration shows an enlarged cross-sectional view of a portion of the first body mounting assembly 800 of FIG. 2 in an assembled condition. In this case, first body mount 600 and first chassis mount 400 are shown interlocked together. In this illustration, a model vehicle body 200 has been secured to a model vehicle chassis 300 even though the portions of the model vehicle body 200 and the model vehicle chassis 300 are not shown in order to aid in clarification of the description (refer to FIG. 1 for the model vehicle body 200 and the model vehicle chassis 300 in an unassembled state).

The chassis mount 400 includes a first retainer assembly 410 configured for accepting and locking with a corresponding structure of the first body mount 600. The first retainer assembly 410 includes a first retainer aperture 420 and a first retainer engagement surface 430. The first retainer engagement surface 430 is provided on a first side of the first retainer aperture 440. In addition to the first retainer engagement surface 430, the first side of the first retainer aperture 440 also includes a first retainer lead-in ramp 435. The first retainer lead-in ramp 435 is angled downward to the right into the first retainer aperture 420. The first retainer lead-in ramp 435 is configured to facilitate alignment and assembly of the first body mount 600 and the first chassis mount 400.

The first retainer engagement surface 430 also extends into the first retainer aperture 410 and is angled downward and to the right, as seen in the figure. While the first retainer lead-in ramp 435 is configured to facilitate alignment and assembly of the first body mount 600 and the first chassis mount 400, the first retainer engagement surface 430 is configured to securely interlock with a corresponding feature of the first body mount 600. Securely interlocking the first body mount 600 to the first chassis mount 400 inhibits or prevents inadvertent or unintentional separation of the model vehicle body 200 from the model vehicle chassis 300, and will be explained later in more detail.

The first retainer aperture 420 further includes a second side of the first retainer aperture 450, opposite to the first side of the first retainer aperture 440. The first retainer aperture 420 is shown in FIGS. 1 and 2 as substantially square so there are two additional sides to the first retainer aperture 420. The substantially square first retainer aperture 420 is configured to accept a correspondingly configured first latch assembly 610. While a square is used in this illustrative example, other embodiments may use other configurations or geometric shapes as appropriate for the application. For example, a triangular, circular, or other geometric shape may also be used instead of a square for the first retainer aperture 420. Whatever shape is used in an embodiment should accommodate and correspond to the overall outer boundary of the associated component in first body mount 600.

The first body mount 600 is coupled to the model vehicle body 200 and is illustrated as comprising a first latch assembly 610. However, in other embodiments, the first body mount 600 may comprise a first retainer assembly 410. In still other embodiments, the first body mount 600 may comprise combinations of a first latch assembly 610 and a first retainer assembly 410. The first latch assembly 610 includes a first latch member 620 comprising a first latch engagement surface 630. In addition, the first latch member 620 comprises a first latch release 640 and a first latch support 650. In embodiments in which a second latch assembly is included in the body mount 600 (see FIG. 2), a latch assembly connecting member 660 may be used to connect the first latch assembly 610 to the second latch assembly. In some embodiments, the latch assembly connecting member 660 may transversely or longitudinally span across the model vehicle 200.

The first latch member 620 is illustrated in this exemplary figure as a resilient U shaped cantilever snap fit latch. However, other latch designs can be used such as cantilever snap fit latches and L shaped cantilever snap fit latches, for example. Further, the U shaped cantilever snap fit first latch member 620 uses a first latch engagement surface 630 that is an angled protrusion configured to interlock with a retainer engagement surface 430 that is also an angled protrusion in the first chassis mount 400. Both of the engagement surfaces (430, 630) are shown at a negative angle (i.e., a negative return angle) to increase the retention ability of the interlocking features.

In most cases of snap fit latch design, the first engagement surface 630 is either perpendicular or at a positive angle (i.e., a positive return angle) to the rest of the first latch member 620. With a perpendicular angle or a positive angle for the first engagement surface 630, the application of an increasing vertical separation force between the model vehicle body 200 and the model vehicle chassis 300 may continue until a point at which the latch member slides over the corresponding interlocking feature. Generally, the latch assembly and corresponding retaining assembly are disengaged without failure of the components in each.

With a negative engagement angle as shown for the first latch member 620, an increasing vertical separation force between the model vehicle body 200 and the model vehicle chassis 300 may result in the failure of one or both of the components in a first latch assembly 610 and/or a first retainer assembly 410. While typical snap fit interlocking latches may be disengaged through the application of a separation force, snap fit interlocking latches with negative engagement angles must be physically disengaged prior to application of a separation force. Application of a separation force between the model vehicle body 200 and the model vehicle chassis 300 would draw the first latch engagement surface 630 and the first retainer engagement surface 430 into a tighter interlocking position usually until a failure occurred.

In order to disengage the first latch assembly 610 from the first retainer assembly, the first latch assembly 610 further includes a first latch release 640. Moving the first latch release member 640 prior to the application of a vertical separation force provides a way to disengage the model vehicle body 200 from the model vehicle chassis 300 without damage. The slanted surface of the first latch release 640 may be at a positive angle (i.e., a positive lead angle) in order to facilitate assembly. As the first latch assembly 610 is inserted into the first retainer assembly 410, first latch release member 640 may slide against the first retainer lead-in ramp 435, also shown at a positive angle (i.e., a positive lead angle). Accordingly, the first latch member 620 is moved to the right of the illustration and then into position within the first retainer assembly 410

A first latch support 650 abuts the second side of the first retainer aperture 450, guiding the rest of the first latch assembly 610 into position for assembly. As the first latch support 650 is inhibited from moving further to the right and as the first latch release member 640 slides against the first retainer lead-in ramp 435, the first latch member 620 resiliently bends to the right as well. When the trailing edge of the first latch release member 640 passes the trailing edge of the first retainer lead-in ramp 435, the first latch member 620 resiliently moves to the left, interlocking together the first latch engagement surface 630 and the first retainer engagement surface 430.

In order to disengage the first latch engagement surface 630 and the first retainer engagement surface 430, the first latch release member 640 is operated or moved closer to the first latch support 650, away from the first retainer engagement surface 430. This allows the first latch engagement surface 630 to vertically clear the first retainer engagement surface 430. While clear, the model vehicle body 200 can be moved vertically to separate from the model vehicle chassis 300. In some cases, the first latch release member 640 is initially operated to clear the first latch engagement surface 630 and operated or moved vertically to disengage the first latch assembly 610 from the first retainer assembly 410, allowing the first body mount 600 to disengage from the first chassis mount 400.

Operating the first latch release member 640 involves opposing the resilient bias produced by the first latch member 620. The resilient bias is in the direction of the first retainer engagement surface 430 during assembly. The bias helps to position the first latch engagement surface 630 in a position to lock with the first retainer engagement surface 430. In addition, the bias may function to keep the first latch engagement member 630 interlocked and engaged with the first retainer engagement member 430 during operation.

In some embodiments in the assembled position shown in FIG. 3, the resilient bias may be zero. However, during assembly when the first release surface 640 slides to the right due to the first retainer lead-in ramp 435 as the first latch member 620 is inserted into the first retainer aperture 420, the resilient bias is built up in the direction of the first retainer engagement surface 430. While in other embodiments, the resilient bias will keep the portion of the first latch member 620 firmly against the left side of the first retainer aperture 420 during normal operation.

As shown in exemplary FIG. 1, this particular embodiment of the current disclosure shows a model vehicle 100 comprising a first body mounting assembly 800 and a second body mounting assembly 900. Again, while two transversely mounted body mounting assemblies 800, 900 are shown, other embodiments may comprise only a single body mounting assembly or three or more body mounting assemblies. The one or more body mounting assemblies 800,900 may further be mounted longitudinally or in any orientation applicable for the intended application in still other embodiments.

In addition, while the first latch assembly 610 is shown in the first body mount 600 and the first retainer assembly 410 is shown in the first chassis mount 400, the numbers of assemblies (both body and retainer) as well as the location of assemblies (body mount and chassis mount) can vary according to embodiment and application. In some cases, the first latch assembly 610 could be in the first chassis mount 400 and the first retainer assembly 410 could be in the first body mount 600. While in still other embodiments, the first body mount 600 could also comprise both a first latch assembly 610 and a first retainer assembly 410, and the first chassis mount 400 would comprise a corresponding alternative set of a first retainer assembly 410 and first latch assembly 610. And in further embodiments, the first body mount 600 may comprise one or more first latch assemblies 610 and one or more first retainer assemblies 410 while the first chassis mount 400 comprises an alternative set of one or more first retainer assemblies 410 and one or more first latch assemblies 610.

As shown in the illustrative embodiment in FIG. 1, the first body mount 600 of the first body mounting assembly 800 and the second body mount 700 of the second body mounting assembly 700 are rigidly coupled to an internal body frame 230. The internal body frame 230 is further coupled to an interior surface of the model vehicle body 200. However, in other embodiments the first body mount 600 and the second body mount 700 may be rigidly coupled directly to the interior surface of the model vehicle body 200. While in still other embodiments, there may be a single internal body frame 230 extending the length of the model vehicle 100 or in other cases, two or more internal body frames such as one for the front of the model vehicle 240 and one for the rear of the model vehicle 250, for example.

FIG. 1 shows the first chassis mount 400 and the second chassis mount 500 are shown having implemented the first and second retainer assemblies 410, 510 at all for wheel wells 310A-D. This creates 2 latching and retaining assemblies per side of the model vehicle 100. The model vehicle front-340, the model vehicle rear-350, the model vehicle left-360 and the model vehicle right 370 may all have redundant body mounting assemblies. Of course, this embodiment and implementation are for illustrative purposes only and other locations and numbers of latching and retaining assemblies may differ according to application.

Figure 4:
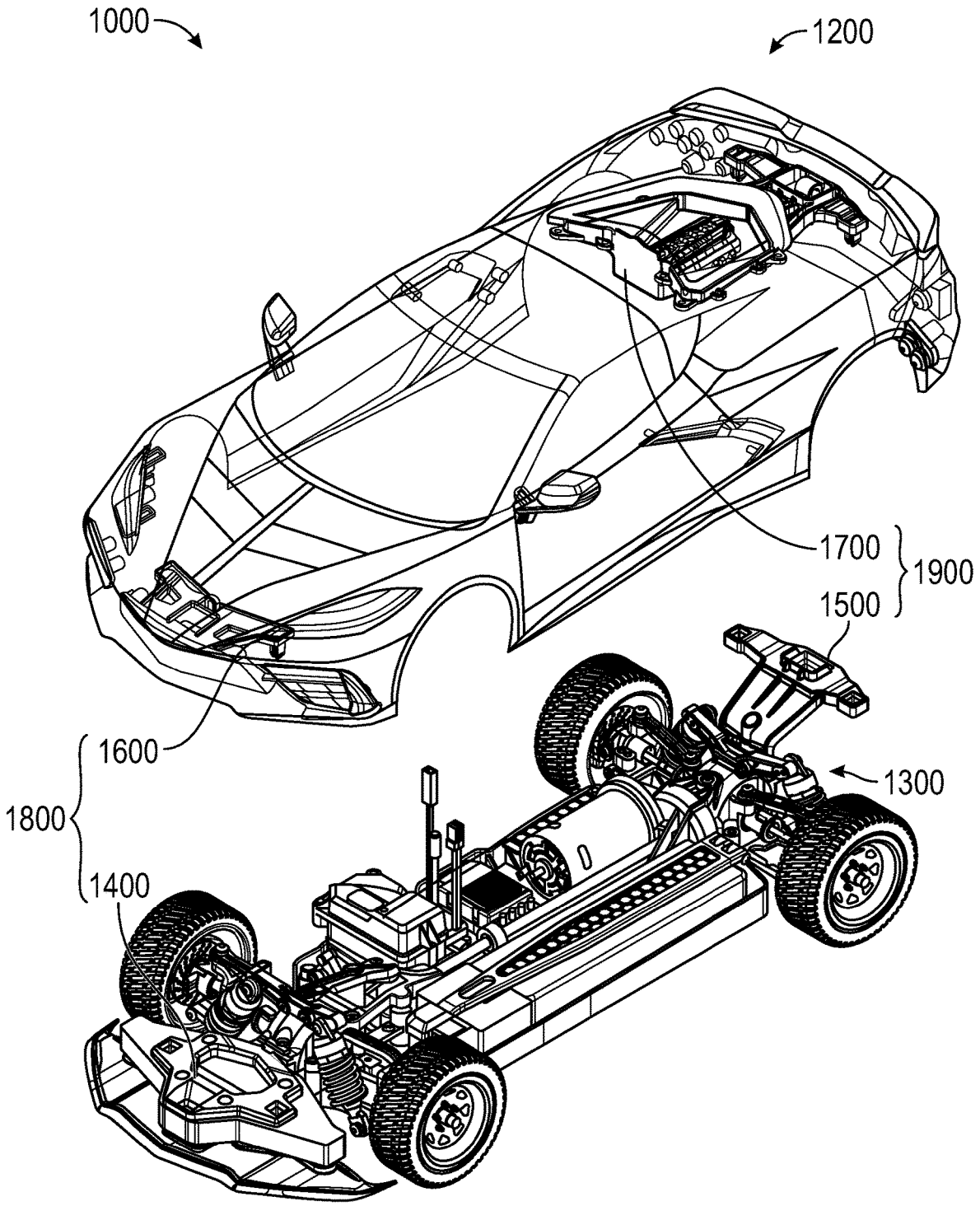
FIG. 4 is a schematic assembly view of a model vehicle body and a model vehicle chassis incorporating a body mounting system, according to another embodiment of the current disclosure.
Figure 5:
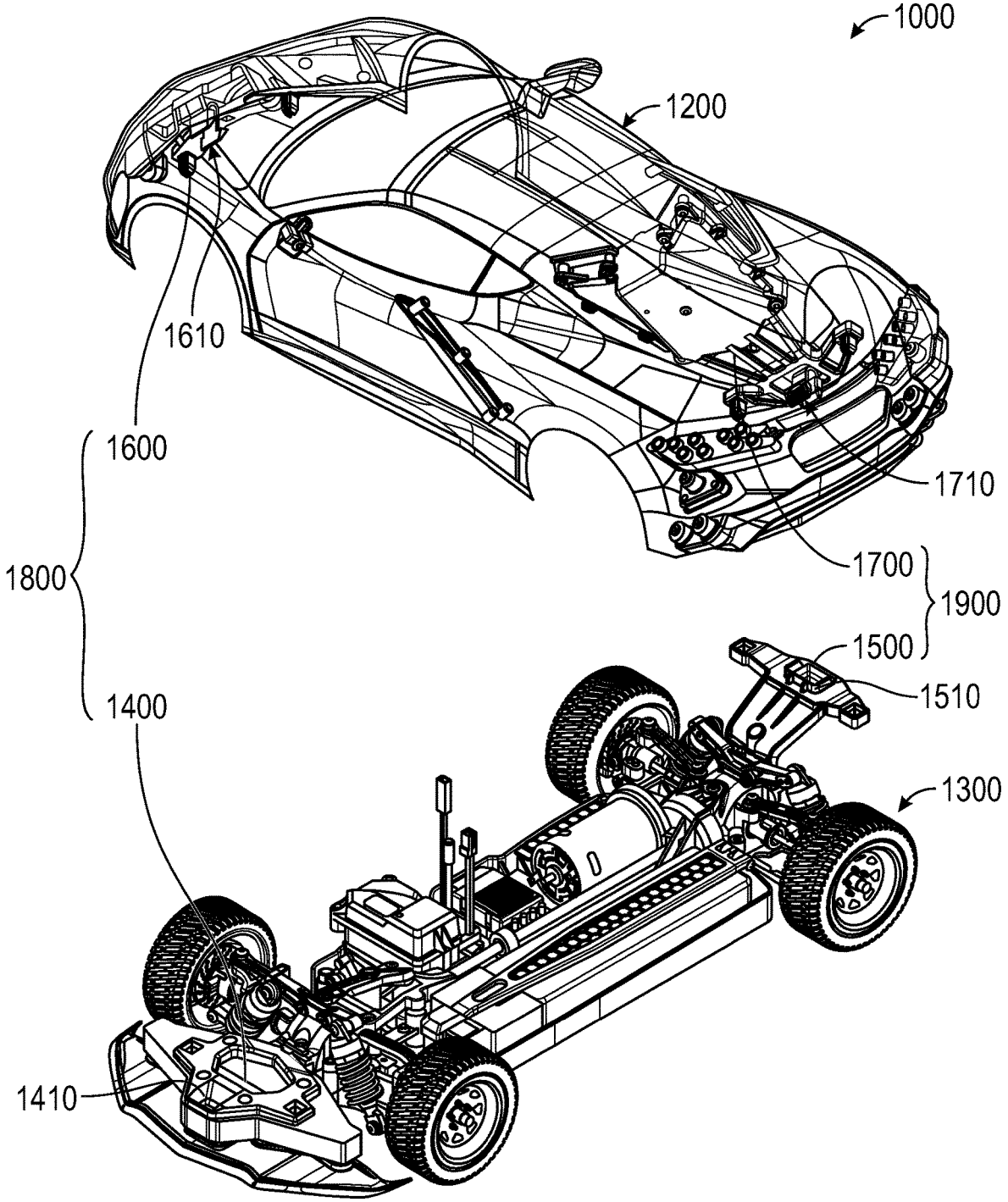
FIG. 5 is another schematic assembly view of the model vehicle body and the model vehicle chassis of FIG. 4, but showing the model vehicle body from a lower view, according to another embodiment of the current disclosure.

Referring generally to FIGS. 4 and 5, theses illustrative schematic assembly drawings show a model vehicle 1000 comprising a model vehicle body 1200 and a model vehicle chassis 1300 incorporating an embodiment of the current disclosure. In this exemplary embodiment, a first body mounting assembly 1800 and a second body mounting assembly 1900 are shown. The first body mounting assembly 1800 comprises the first body mount 1600 and the first chassis mount 1400. The second body mounting assembly 1900 comprises the second body mount 1700 and the second chassis mount 1500. In FIG. 5, the model vehicle body 1200 illustrates from a lower perspective view which shows a different perspective of the first body mount 1600 and the second body mount 1700.

Figure 6:
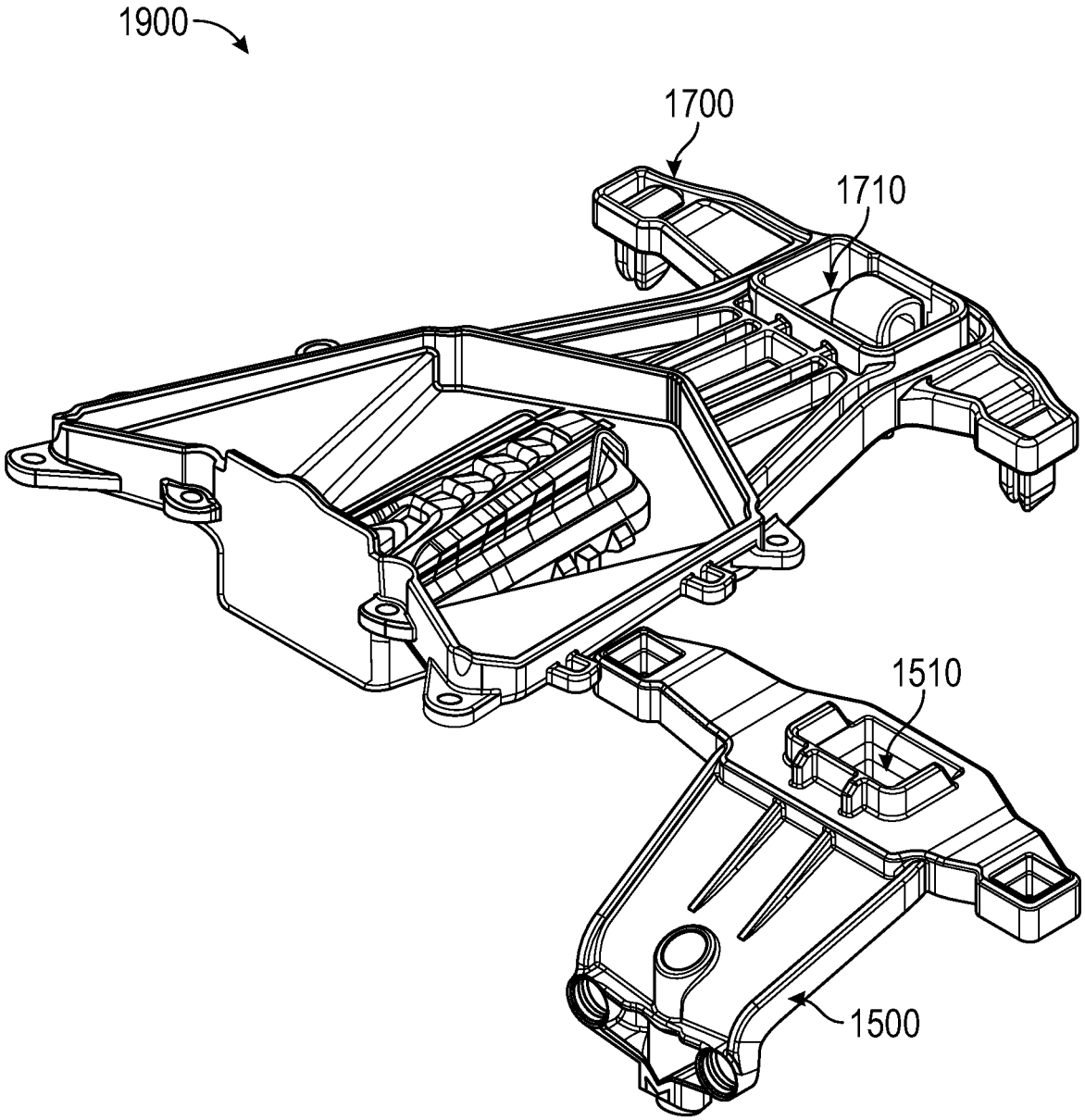
FIG. 6 is a schematic assembly view of the second body mounting assembly comprising a body mount and a chassis mount of the body mounting assembly of FIGS. 4 and 5, shown prior to assembly, according to another embodiment of the current disclosure.

Turning now to FIG. 6, this illustrative figure shows an enlarged perspective schematic view of the second body mounting assembly 1900 of FIGS. 4 and 5 without the model vehicle body 1200 or the model vehicle chassis 1300 of the model vehicle 1000 in the interest of increasing clarity. The second body mount 1700 and the second chassis mount 1500 are shown in an unassembled state. In order to assemble the two mounts 1500, 1700, the second body mount 1700 would be brought lower until it engages the second chassis mount 1500. The assembly would continue until a second latching assembly is able to engage a second retainer assembly (discussed later). With the second latching assembly engaged with the second retainer assembly, the model vehicle body 1200 is secured to the model vehicle chassis 1300 and the model vehicle 1000 is ready for operation.

Figure 7:
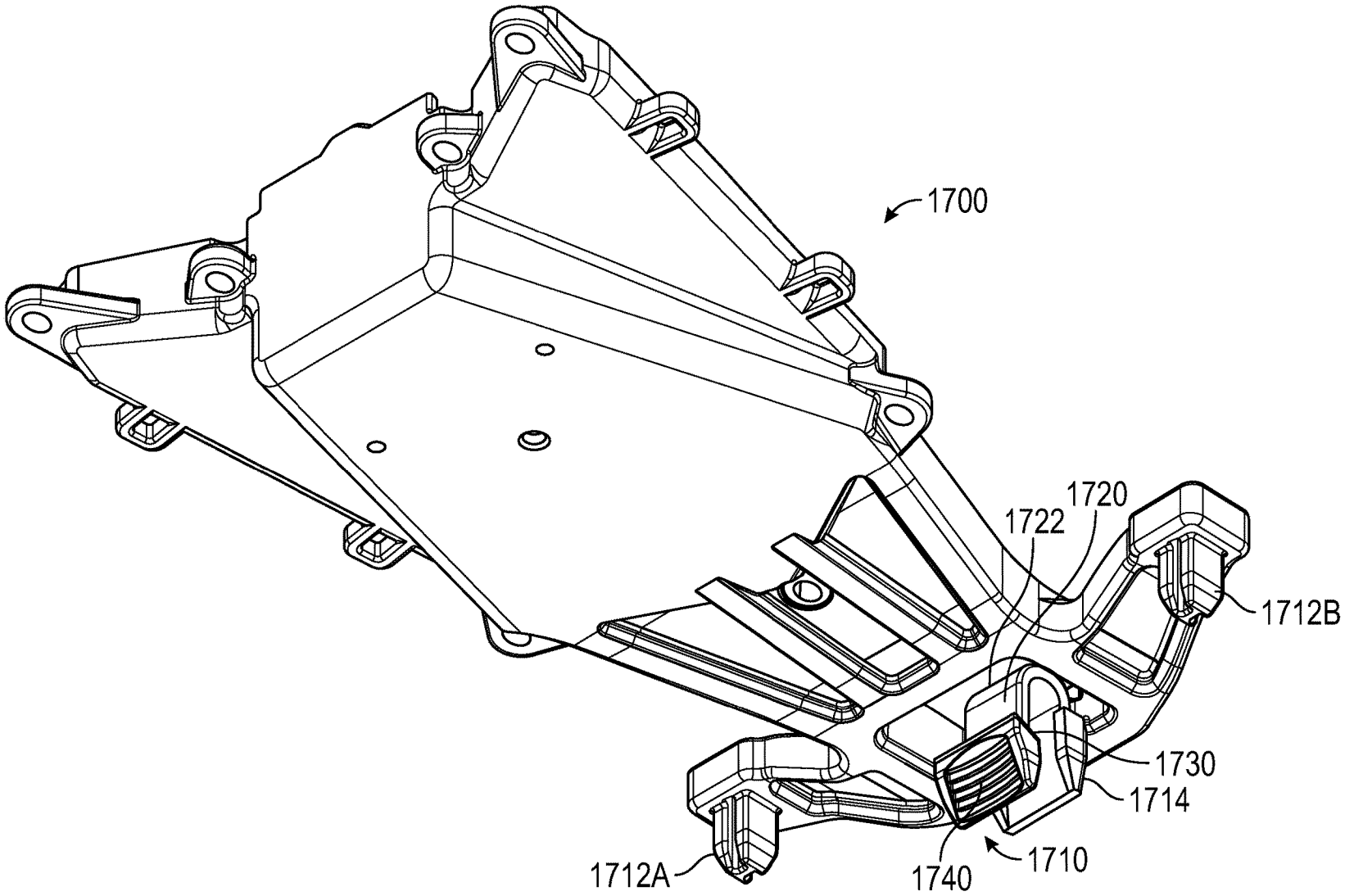
FIG. 7 is an enlarged schematic perspective view of the body mount of FIG. 6 shown from a lower perspective, according to another embodiment of the current disclosure.

Referring to FIG. 7, this exemplary illustration shows an enlarged lower perspective schematic view of the second body mount 1700 of FIG. 6. As shown in this view, the second body mount 1700 comprises a second latch assembly 1710. However, in other embodiments the second body mount 1700 may comprise two or more second latch assemblies 1710. Comparing the first body mount 1600 and the second body mount 1700 in FIG. 5, both the first and the second body mounts 1600, 1700 have a single latch assembly (1610, 1710). However, the number of latch assemblies 1610, 1710 does not have to be equal to one another in each of the body mounts 1600, 1700. In addition, one body mount (1600, 1700) may include a latch assembly (1610, 1710) while the other body mount (1700, 1600) may include a retainer assembly (1510, 1410).

In some embodiments, the body mounts (1600, 1700) may comprise different numbers and combinations of latch assemblies (1610, 1710) and/or retainer assemblies (1510, 1410) as appropriate for a particular embodiment. In some cases, the second body mount 1700 may comprise both a second latch assembly 1710 and a second retainer assembly 1510 while the second chassis mount 1500 comprises a corresponding set of a second retainer assembly 1510 and a second latch assembly 1710.

As shown, this embodiment of the second latch assembly 1710 includes a second latch support 1714, a second latch member 1720 with a second latch resilient arch 1722, a second latch engagement surface 1730, and a second latch release 1740. As with the first embodiment, the second latch engagement surface 1730 is shown at a negative angle (i.e., a negative return angle) while the second latch release 1740 is shown at a positive angle (i.e., a positive lead angle). This illustrative example of a second latch assembly 1710 comprises a resilient U-shaped cantilever snap-fit latch. However, other configurations of snap fit latches can be used such as a cantilever snap-fit latch and an L-shaped cantilever snap-fit latch, among others according to the requirements of the application.

Figure 9:
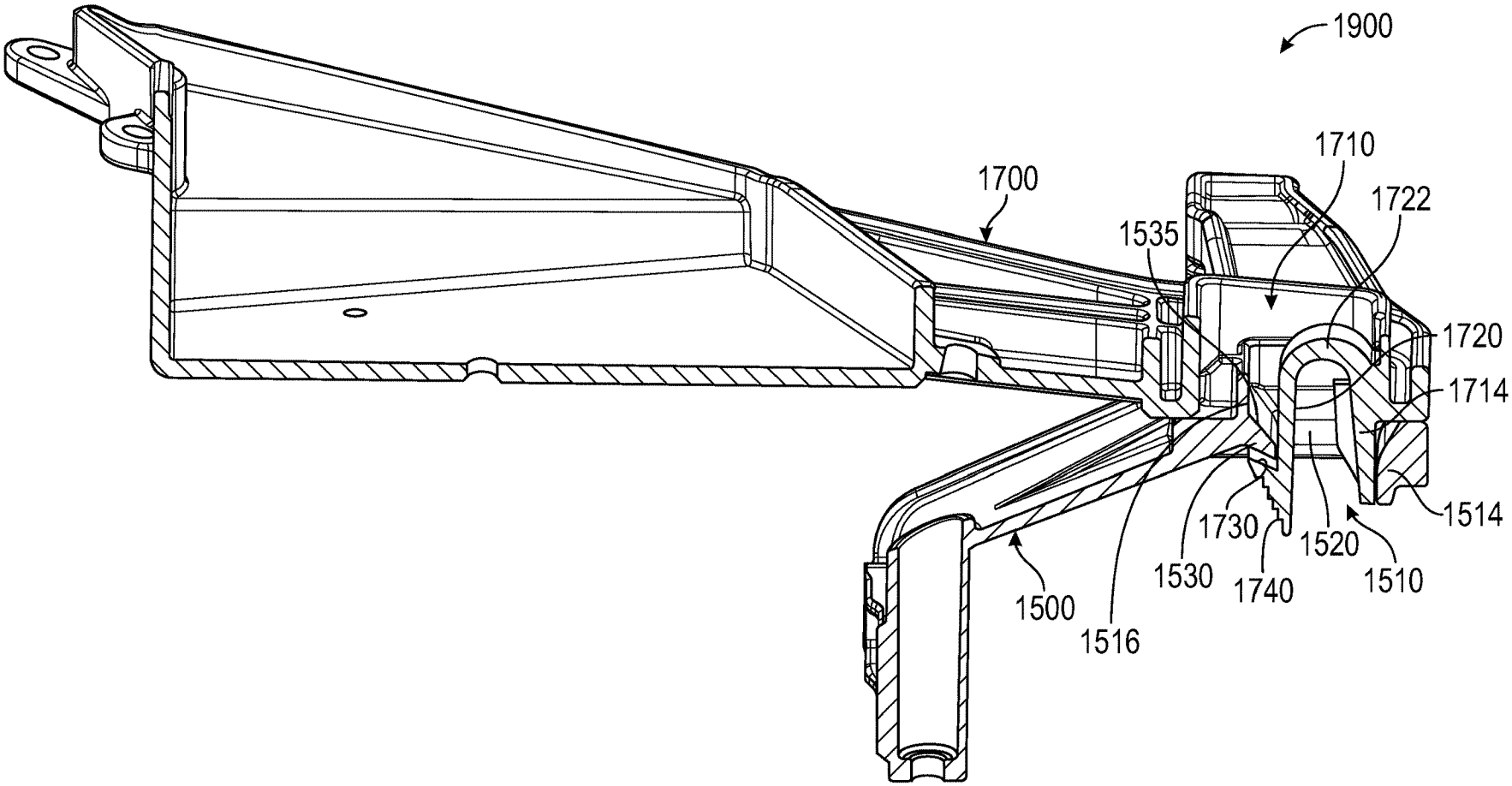
FIG. 9 is an enlarged sectional view of the body mount and the chassis mount of FIG. 6 shown in an assembled position, according to another embodiment of the current disclosure.

The use of a second latch resilient arch 1722 allows for very large deflections of the end portion (i.e., distal portion) of the second latch member 1720 that comprises the second engagement surface 1730 and the second latch release 1740 (also refer to FIG. 9). The second latch resilient arch 1722 facilitates the very large deflections without inducing high strains at the base of the second latch member 1720. Both U-shaped cantilever snap-fit latches and L-shaped cantilever snap-fit latches allow for a reduction in strain caused by the deflection as compared to a typical cantilever snap-fit latch.

The second latch assembly 1710 is shown in this illustrative embodiment with a substantially square overall horizontal circumference. This configuration matches the substantially square overall horizontal circumference of the second retainer assembly 1510 (explained in more detail later). By having a substantially square overall horizontal circumference, primary forces between the model vehicle body 1200 and the model vehicle chassis 1300 along an x-axis and y-axis are restrained by corresponding flat sides of the substantially square configuration, distributing the force along the sides. However, in other embodiments other geometric configurations may be used depending upon the application. For example, substantially circular and triangular horizontal circumferences among others may provide a more appropriate configuration for an embodiment.

In addition to the second latch assembly 1710, this embodiment of the second body mount 1700 further comprises second reinforcement members 1712A, 1712B. The second reinforcement members 1712A, 1712B provide additional support along at least one geometric axis to an assembled second body mounting assembly 1900. In this exemplary embodiment, the second reinforcement members 1712A, 1712B provides additional support along two perpendicular horizontal directions, i.e., the x and y axis.

Including the second reinforcement members 1712A, 1712B in the second body mounting assembly 1900 may reduce or inhibit some of the resultant forces generated during operation of the model vehicle 1000 that act on the second retainer assembly 1510 and the second latch assembly 1710, between the model vehicle body 1200 and the model vehicle chassis 1300. In addition, the length of the second reinforcement members 1712A, 1712B may also function as a guide to facilitate placing the model vehicle body 1200 in the proper position relative to the model vehicle chassis 1300 during assembly. In some cases, the distal end of the second reinforcement members 1712A, 1712B may be tapered to aid insertion into the second reinforcement retainers 1512A, 1512B. The length of the second reinforcement members 1712A, 1712B may also help to keep the model vehicle body 1200 in place during a failure of either the second retainer assembly 1510 and/or the second latch assembly 1710.

In this embodiment, the second reinforcement members 1712A, 1712B are shown as extended rectangular protrusions with a substantially square perimeter as a horizontal cross-section (i.e., actual cross-section is in the form of an I-beam). However, other horizontal configurations may be used as second reinforcement members 1712A, 1712B, according to the needs of an embodiment or application. For example, the protrusions may be cylindrical with circular horizontal cross-sections or even comprising triangular or other combinations of polygonal, or arcuate shaped horizontal cross-sections. As with the second latch support 1714, the distal (i.e., the lower as seen in the figure) end of the second reinforcement members 1712A, 1712B may be narrowed with angled surfaces to facilitate assembly and mating with corresponding second reinforcement retainers 1512A, 1512B (see FIG. 8) of the second chassis mount 1500.

Figure 8:
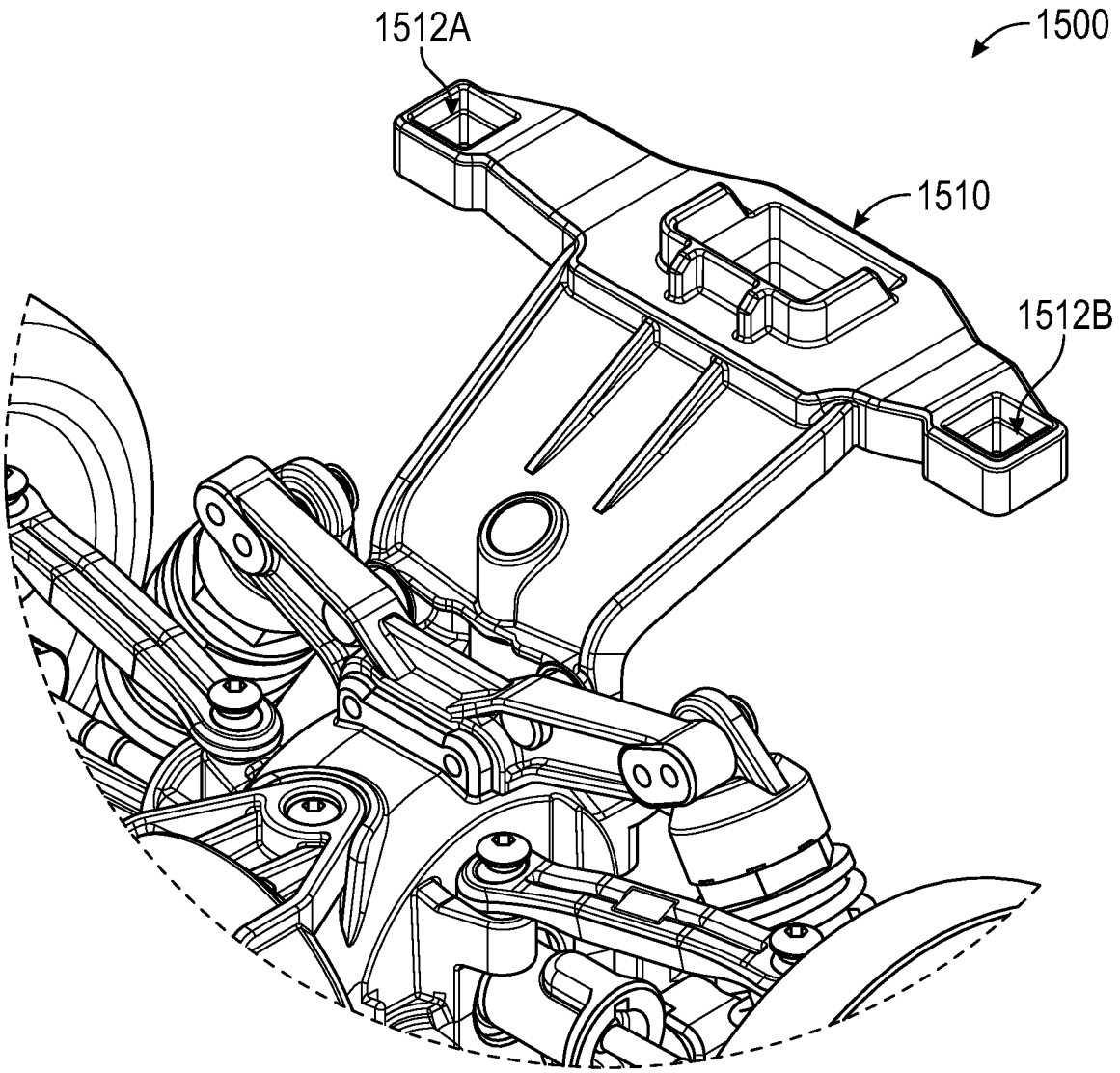
FIG. 8 is an enlarged partial view of the chassis of FIGS. 4 and 5 showing the chassis mount of FIG. 6 attached to the model vehicle chassis, according to another embodiment of the current disclosure.

Referring now to FIG. 8, this figure is an exemplary illustration of an enlarged partial schematic assembly view of the second chassis mount 1500 as shown in FIGS. 4 and 5. In this view, the second retainer assembly 1510 is visible showing the top of the second retainer aperture 1520 and the second reinforcement retainers 1512A, 1512B. As with other components, the leading entry into the upper portions (as seen in this view) of the second retainer aperture 1520 and the second reinforcement retainers 1512A, 1512B, are enlarged with angled surfaces. The angled surfaces facilitate assembly, guidance, and engagement with the second latch assembly 1710 and the second reinforcement members 1712A, 1712B of the second body mount 1700.

Turning generally to FIG. 9, the embodiment of the second body mounting assembly 1900 is shown in an assembled configuration in which the second body mount 1700 and the second chassis mount 1500 are engaged or interlocked together. In this view, the remaining structure and individual components of the second retainer assembly 1510 can be seen. As shown, the second retainer assembly 1510 comprises a second retainer aperture 1520 including a first side of the second retainer aperture 1516 and a second side of the second retainer aperture 1514.

The first side of the second retainer aperture 1516 comprises a second retainer lead-in ramp 1535 that moves the lower (or distal) portion of the second latch member 1720 to the right (as seen in the figure), as the second latch release member 1740 slides over the second retainer lead-in ramp 1535 during assembly. This results in the generation of a resilient force urging the lower portion of the second latch member 1720 to the left (as seen in the figure). When the highest portion of the second latch release member 1740 clears the lowest portion of the second retainer lead-in ramp 1535, the lower portion of the second latch member 1720 resiliently moves to the left, resulting in the second latch engagement surface 1730 opposing the second retainer engagement surface 1530.

The second latch engagement surface 1730 and the second retainer engagement surface 1530 each have a negative engagement angle or a negative return angle. Since both engagement surfaces 1530, 1730 have a negative engagement angle, attempting to vertically remove the model vehicle body 1200 from the model vehicle chassis 1300 will result in the lower portion of the second latch member 1720 being drawn to the leftmost position in the second retainer aperture 1520, furthering the engagement between the second latch engagement surface 1730 and the second retainer engagement surface 1530. Unlike other snap-fit latch designs, application of additional separation force will eventually result in failure of the second latch assembly 1710, the second retainer assembly 1510, or both.

Application of a horizontal force upon the second latch release member 1740 to the right, moves the second latch engagement surface 1730 out of engagement or interlock with the second retainer engagement surface 1530. Application of a vertical force to separate the model vehicle body 1200 from the model vehicle chassis 1300 then results in disengagement of the second body mount 1700 from the second chassis mount 1500 and upon disengagement of all body mounting assemblies (1800, 1900, etc.), the model vehicle body 1200 is removable from the model vehicle chassis 1300.

During assembly, the second retainer lead-in ramp 1535 moves the lower portion of the second latch member 1720 to the right. As shown in FIG. 9, the base of the second latch member 1720 is inhibited or resisted from moving right by a corresponding amount due to the interaction of the second latch support member 1714 and the second side of the second retainer aperture 1540. The second latch support member 1714 abuts the second side of the second retainer aperture 1514 preventing further horizontal translation of the second latch assembly 1710 relative to the second retainer assembly 1510. In addition, the interaction of the second reinforcement members 1712A, 1712B and the second reinforcement retainers 1512A, 1512B also inhibit or restrict horizontal movement of the second latch assembly 1710 relative to the second retainer assembly 1510.

In some embodiments, the interlocking second latch engagement surface 1730 and the second retainer engagement surface 1530 may function to resist the vertical separation of the model vehicle body 1200 from the model vehicle chassis 1300. The second latch support member 1714 abutting the sides of the second retainer aperture 1520 and/or the second reinforcement members 1712A, 1712B abutting the sides of the second reinforcement retainers 1512A, 1512B may function to inhibit or restrain the horizontal motion of the model vehicle body 1200 relative to the model vehicle chassis 1300. While the second latch support member 1714 sliding against the sides of the second retainer aperture 1520 and/or the second reinforcement members 1712A, 1712B sliding against the second reinforcement retainers 1512A, 1512B may also function to facilitate guiding the model vehicle body 1200 to the appropriate mounting location or position relative to the model vehicle chassis 1300.

The inhibition or restriction of the second latch assembly 1710 moving horizontally relative to the second retainer assembly 1510 while the lower portion of the second latch member 1720 moving to the right (as seen in FIG. 9) due to the second retainer lead-in ramp 1535 during assembly, results in at least some of the resilient force being generated to urge the lower portion of the second latch member 1720 to the left (as seen in the figure). Appropriate design of the second latch member 1720 can result in a generated resilient force strong enough to resist disengagement during operation of the model vehicle 1000 while still allowing for a reasonable disassembly or disengagement force.

Still another illustrative embodiment includes a method for securing a model vehicle body to a model vehicle chassis. This method involves providing a latch assembly that includes a latch member. The latch member further includes a latch engagement surface. Also, the method includes providing a retainer assembly that includes a retainer aperture. The retainer aperture includes a retainer engagement surface.

The method may further include engaging the latch assembly and the retainer assembly, interlocking the latch engagement surface and the retainer engagement surface. Wherein a body mount coupled to a model vehicle body comprises one of the latch assembly or the retainer assembly. Also, wherein a chassis mount coupled to a model vehicle chassis comprises a corresponding other of the retainer assembly or the latch assembly corresponding to the body mount. Still further, wherein the latch engagement surface and the retainer engagement surface comprise negative engagement angles.

Some embodiments of the method may further include providing a latch release member on the latch member and moving the latch release member in a horizontal direction to decouple the latch assembly and the retainer assembly from engagement after assembly. In addition, embodiments may include providing a reinforcement member and a reinforcement retainer, wherein the body mount includes one of the reinforcement member or the reinforcement retainer. Also, wherein the chassis mount further includes a corresponding other of the reinforcement retainer or the reinforcement member, and wherein the reinforcement member is constrained in at least one direction by the reinforcement retainer after assembly.

Elements of the embodiments have been introduced with either the articles "a" or "an." The articles are intended to mean that there are one or more of the elements. The terms "including" and "having" are intended to be inclusive such that there may be additional elements other than the elements listed. The term "or" when used with a list of at least two elements is intended to mean any element or combination of elements.

Although only a few example embodiments have been described in detail above, those skilled in the art will readily appreciate that a wide range of variations, modifications, changes, and substitutions are contemplated in the foregoing disclosure and, in some instances, some features of the present disclosure may be employed without a corresponding use of the other features In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

It is the express intention of the applicant not to invoke 35 U.S.C. § 112, paragraph 6 for any limitations of any of the claims herein, except for those in which the claim expressly uses the words 'means for' together with an associated function.

What is claimed is:

1. A body mounting assembly comprising:

a latch assembly comprising:

a latch member comprising:

a latch engagement surface;

a retainer assembly comprising:

a retainer engagement surface;

wherein the latch assembly is releasably coupled to the retainer assembly when the latch engagement surface and the retainer engagement surface interlock together;

wherein the latch engagement surface and the retainer engagement surface comprise negative engagement angles;

wherein a body mount configured to be coupled to a model vehicle body comprises one of the latch assembly or the retainer assembly; and wherein a chassis mount configured to be coupled to the model vehicle chassis comprises a corresponding one of the retainer assembly or the latch assembly corresponding to the body mount.

2. The body mounting assembly according to claim 1, wherein the latch member further comprises:

a latch release member:

wherein the latch assembly is released from the retainer assembly via operation of the latch release member.

3. The body mounting assembly according to claim 2, wherein the retainer assembly further comprises:

a retainer aperture configured to accommodate at least a portion of the latch member;

wherein the retainer engagement surface is provided on a first side of the retainer aperture.

4. The body mounting assembly according to claim 3, wherein operation of the latch release member comprises application of a horizontal force directed against the latch release member in a horizontal direction.

5. The body mounting assembly according to claim 4, wherein a bias of the latch release member is in a second horizontal direction opposite to the horizontal direction and towards engaging the latch engagement surface and the retainer engagement surface.

6. The body mounting assembly according to claim 4, wherein the latch assembly further comprises a latch support; and wherein the latch support abuts a second side of the retainer aperture opposite the first side of the retainer aperture.

7. The body mounting assembly according to claim 3, wherein one of the body mount or the chassis mount further comprises a reinforcement member;

wherein another of the corresponding chassis mount or the body mount further comprises a reinforcement retainer; and wherein the reinforcement member is constrained in at least one direction by the reinforcement retainer after assembly.

8. The body mounting assembly according to claim 1, wherein the body mount is provided proximate to a first body wheel well and the chassis mount is provided proximate to a first chassis wheel well corresponding to the first body wheel well.

9. The body mounting assembly according to claim 1, further comprising:

a second latch assembly comprising:

a second latch member comprising:

a second latch engagement surface;

a second retainer assembly comprising:

a second retainer engagement surface;

wherein the second latch assembly is releasably coupled to the second retainer assembly via the second latch engagement surface interlocking with the second retainer engagement surface;

wherein the second latch engagement surface and the second retainer engagement surface comprise negative engagement angles;

wherein the body mount further comprises one of the second latch assembly or the second retainer assembly;

wherein the chassis mount further comprises a corresponding one of the second retainer assembly or the second latch assembly corresponding to the body mount.

10. The body mounting assembly according to claim 9, wherein the one of the latch assembly or the retainer assembly of the body mount is rigidly coupled to the one of the second latch assembly or the second retainer assembly of the body mount via a latch assembly connecting member.

11. The body mounting assembly according to claim 9, wherein the one of the latch assembly or the retainer assembly of the body mount is configured to be provided proximate to a first body wheel well in the model vehicle body and the corresponding one of the retainer assembly or the latch assembly of the chassis mount is configured to be provided proximate to a first chassis wheel well in the model vehicle chassis corresponding to the first body wheel well; and wherein the one of the second latch assembly or the second retainer assembly of the body mount is configured to be provided proximate to a second body wheel well in the model vehicle body and the corresponding one of the second retainer assembly or the second latch assembly is configured to be provided proximate to a second chassis wheel well provided in the model vehicle chassis corresponding to the first body wheel well.

12. The body mounting assembly according to claim 11, wherein the first and the second body wheel wells and the first and the second chassis wheel wells are provided on a first model vehicle side.

13. The body mounting assembly according to claim 12, wherein the first model vehicle side is a front of the model vehicle.

14. A model vehicle comprising a body mounting assembly comprising:

a reinforcement member;

a reinforcement retainer;

a latch assembly comprising:

a latch member comprising:

a latch engagement surface;

a retainer assembly comprising:

a retainer aperture comprising;

a retainer engagement surface; and wherein a first side of the retainer aperture comprises the retainer engagement surface;

wherein the latch assembly is releasably coupled to the retainer assembly when the latch engagement surface and the retainer engagement surface interlock together;

wherein the reinforcement member is constrained in at least one direction by the reinforcement retainer after assembly;

wherein the latch engagement surface and the retainer engagement surface comprise negative engagement angles;

wherein a body mount coupled to a model vehicle body comprises one of the latch assembly or the retainer assembly and one of the reinforcement member or the reinforcement retainer; and wherein a chassis mount coupled to a model vehicle chassis comprises a corresponding other of the retainer assembly or the latch assembly and a corresponding other of the reinforcement retainer and the reinforcement member corresponding to the body mount.

15. The model vehicle according to claim 14, wherein the chassis mount and the body mount are provided proximate to a first model vehicle side.

16. The model vehicle according to claim 14, further comprising:

a second reinforcement member;

a second reinforcement retainer;

a second latch assembly comprising:

a second latch member comprising: and a second latch engagement surface;

a second reinforcement retainer;

a second retainer assembly comprising:

a second retainer aperture comprising;

a second retainer engagement surface; and wherein a first side of the second retainer aperture comprises the second retainer engagement surface;

wherein the second latch assembly is releasably coupled to the second retainer assembly when the second latch engagement surface and the second retainer engagement surface interlock together;

wherein the second reinforcement member is constrained in at least one direction by the second reinforcement retainer after assembly;

wherein the second latch engagement surface and the second retainer engagement surface comprise negative engagement angles;

wherein a second body mount further comprises one of the second latch assembly or the second retainer assembly and one of the second reinforcement member or the second reinforcement retainer; and wherein a second chassis mount further comprises a corresponding other one of the second retainer assembly or the second latch assembly corresponding to the second body mount and a corresponding one of the second reinforcement retainer or the second reinforcement member corresponding to the second body mount.

17. The model vehicle according to claim 16, wherein the chassis mount and the body mount are provided proximate to a first model vehicle side; and wherein the second chassis mount and the second body mount are provided proximate to a second model vehicle side located opposite to the first model vehicle side.

* * * * *